United States Patent [19]

Barnes et al.

[11] 4,206,882

[45] Jun. 10, 1980

[54] GRANULATOR BLADE CONSTRUCTION

[75] Inventors: William Barnes, South Attleboro; Roy W. Gerstenberg, Norfolk, both of Mass.; Gomer E. Kropa, Midland, Mich.; Thomas M. Oakes, Providence, R.I.

[73] Assignee: Leesona Corp., Warwick, R.I.

[21] Appl. No.: 947,772

[22] Filed: Oct. 2, 1978

[51] Int. Cl.[2] ..... B02C 18/16

[52] U.S. Cl. ..... 241/221; 241/73

[58] Field of Search ..... 241/224, 221, 222, 73

[56] References Cited

PUBLICATIONS

*Herringbone Granulator,* Ramco Industries, Inc., 4–1978.

*Primary Examiner*—Mark Rosenbaum

*Attorney, Agent, or Firm*—Robert J. Doherty

[57] ABSTRACT

A novel cooperative blade construction for the rotor and bed knives of a size reduction machine such as a granulator and the like wherein each of the blades are of an overall chevron configuration so as to form a generally trapezoidal opening therebetween. As the blades progressively move past each other, the height of the trapezoidal opening is reduced such that articles to be granulated are initially contacted at opposed laterally spaced points on opposite sides thereof such that articles are clamped and progressively cut with a minimum of energy consumption, noise and fines production. The generally centrally located peaks of the rotor blades and the bed knife blades are also arcuately displaced away from a radial plane passing through the opposite side portions. The blades progressively move past each other while maintaining an equal cutting gap therebetween.

10 Claims, 8 Drawing Figures

GRANULATOR BLADE CONSTRUCTION

BACKGROUND AND SUMMARY OF THE INVENTION

The present invention is directed to a size reduction device and especially a granulator such that scrap plastic material may be granulated for reprocessing. Devices of this general nature are in common application throughout the plastics industry. Desirable features of such devices include operation at relatively low energy consumption and noise levels, minimum production of fines, smooth intake of the scrap material to the device without excessive fly back or bounce back thereof, satisfactory knife life and the ability to resharpen the knives without undesirably affecting the operation of the device, and even loading of operational bearings so as to insure satisfactory wear or avoidance of oversized bearings.

While known devices accomplish several of these desirable objectives, there remains a need for a single machine which fulfills all of such objectives in an efficient and trouble-free manner. Thus, for example, it is known to angle either a rotor or bed knife for coation with an opposed straight knife such that the knives progressively move past each other, thus avoiding cutting material across the full lengths thereof at one time. Such angled knife construction serves to reduce power consumption and noise levels to some extent since material is being progressively cut. It is also known to angle both the rotor blade and the bed knife such that a scissors type cutting action is set up, however, constructions of this type while producing favorable cutting action when the knives are new and thus present and even gap along the opposed cutting edges as they progressively move past each other, present problems when the knives are dull. Under dulled and thus unfavorable cutting conditions, the material initially contacted by the cutting nip tends to laterally push the material to one side of the granulator, thus requiring more cutting action by the blade portion disposed at that side. Uneven wear of the blades thus occurs. Such construction, by reason of its tending to push material towards one side of the chamber, also builds up frictional heat and places a greater force on the rotor bearing on that side of the chamber resulting in an unbalanced load and requirement to either use oversized or special bearings. This condition is also undesirable in that it tends to create fines by the continued rubbing of the laterally forced material up against the far chamber side.

The above-discussed blade construction also do not adequately clamp or progressively engage articles disposed therebetween and enable the articles to some extent undesirably squirm or move about prior to initiating a cutting or breaking action. Such undesirable squirm to some extent has been eliminated by the use of a chevron figured rotor blade construction moving past a straight bed knife. It is also known to utilize the dual chevron configuration in which the central peak of both the rotor and bed knife are directed towards each other so as to initiate a central cut on opposite sides of the article being granulated, although such construction also tends to force material to both sides of the granulator chamber inasmuch as a dual scissor cut action is in reality set up and thus results in undesirable fines and frictional heat.

It is accordingly a primary object of the present invention to provide a size reduction device of the present type which avoids the above-discussed prior art drawbacks and which simultaneously accomplishes all of the aforementioned desirable objectives.

This and other objects of the present invention are accomplished by a device for the size reduction of material comprising a frame, a chamber, a rotor mounted for rotation about an axis within said chamber, cutting means affixed to said rotor, bed knife means mounted on said frame for projection into said chamber thereof for cooperative cutting relationship with said cutting means as said rotor is driven, said cutting means including a rotor blade extending laterally across the face of said rotor with the forward cutting edge thereof defining the circumferential cutting plane of said rotor, said rotor blade of an overall generally chevron configuration having side portions thereof laterally angularly slanted towards each other to define a central peak thereof, said peak being further arcuately displaced from a radial plane passing through the laterally spaced sides of said blade in a rotational direction opposite to that of said rotor said bed knife means including a similarly chevron shaped bed knife disposed with the peak thereof directed opposite to that of said rotor blade and with the cutting edge thereof radially outwardly offset from said rotor blade and further disposed with the peak thereof arcuately displaced from the sides thereof in the opposite direction of the displacement of said rotor blade such that the cutting edges of said blades may progressively pass across each other in evenly spaced relationship and form a progressively flatter generally trapezoidal opening therebetween upon such relative motion whereby articles to be cut thereby are contacted by said blades at laterally spaced locations on opposite surfaces thereof so as to clamp said articles within said opening.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
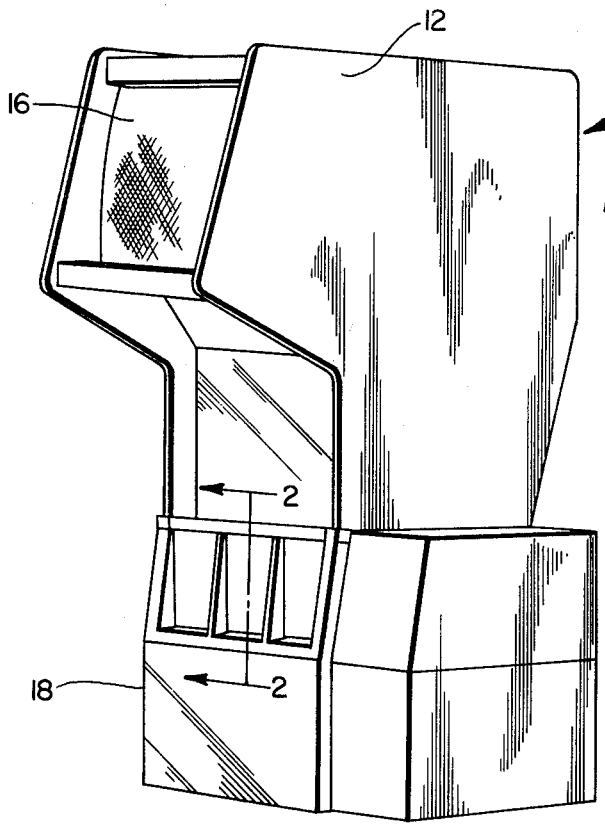
FIG. 1 is a perspective view of a granulator incorporating the present invention.
Figure 4:
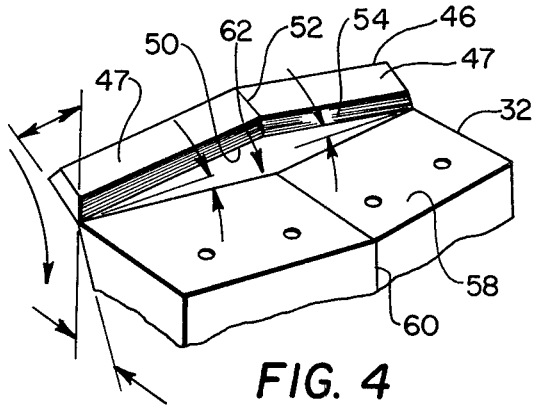
FIG. 4 is a perspective partially stylized view showing the manner in which the rotor and the bed blade meet in cutting opposition illustrated from the downstroke side of the chamber.
Figure 2:
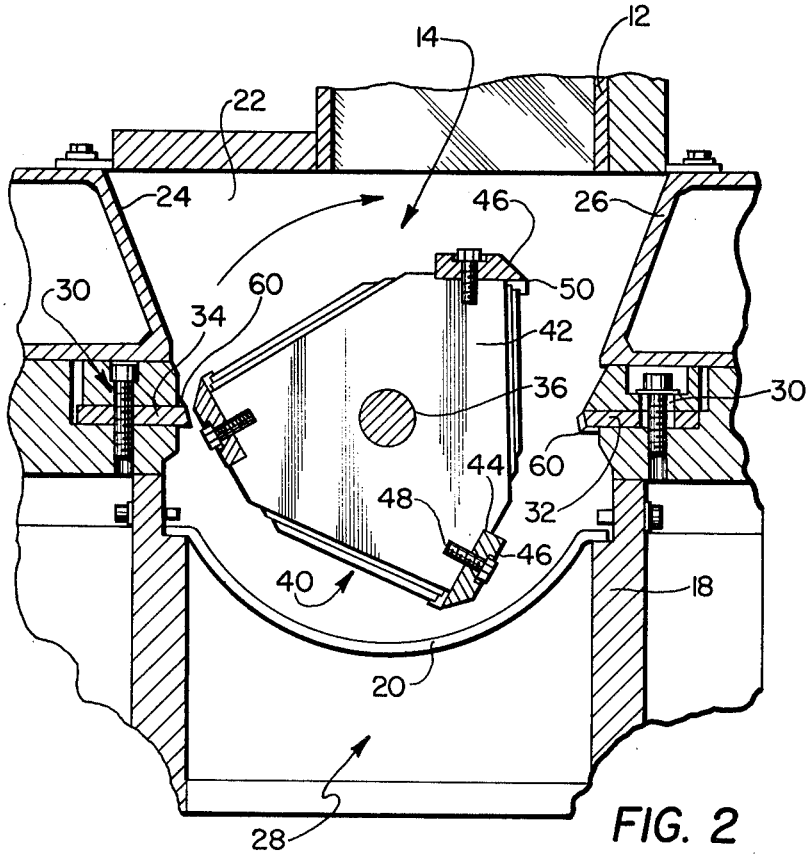
FIG. 2 is a side sectional elevational view thereof taken along the line 2—2 of FIG. 1.
Figure 3:
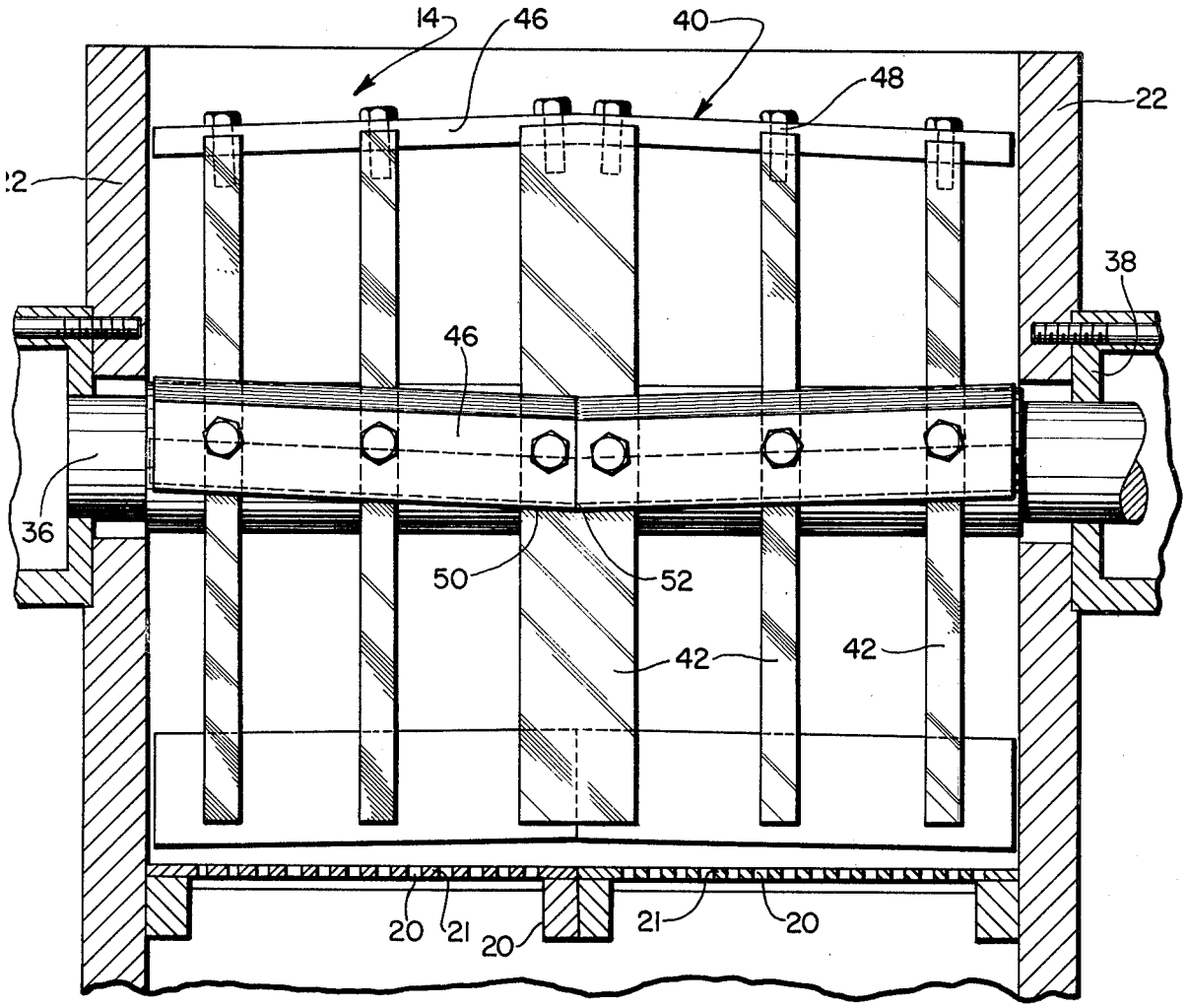
FIG. 3 PRIOR ART
FIG. 3 is a front view of the rotor taken on the upstroke side of the chamber.

Turning now to the drawings and particular FIGS. 1 and 2 thereof, there is shown a granulator identified by reference numeral 10. This granulator includes a hopper 12 into which scrap plastic material and the like are fed to the cutting chamber 14 via the opening 16. The granulator includes a frame 18 and a screen 20 which forms the lower region of the cutting chamber 14. The chamber includes opposite sidewalls 22 and front and rear walls 24 and 26, respectively, both of which may be outwardly pivoted so as to gain access to the chamber 14 on both the upstroke and downstroke sides thereof. As illustrated in FIG. 2, the downstroke side of the chamber is on the righthand side, while the upstroke side is on the lefthand side. The screen or screens 20 includes a plurality of holes or openings 21 of a size predetermined by the size of particulate which will be permitted to be discharged from the cutting chamber 14. The particulate granulated within the cutting chamber 14 moves outwardly from the cutting chamber for discharge downwardly through the confined throat 28. A pair of bed knives are mounted on the frame 18 so as to be adjustable towards and away from the chamber 14 by adjustment means 30 with the bed knife on the downstroke side of the chamber as designated by reference numeral 32 while that on the upstroke side is designated by reference numeral 34.

A shaft 36 is disposed horizontally across the chamber 14 and suitably mounted in the sidewalls 22 by bearing blocks 38. Mounted on the shaft 36 is a rotor 40 formed from a plurality of laterally spaced, radially extending plates 42. The terminal ends of the plates are machined to form angled pockets 44 which each receive one of a plurality of rotor blades 46 thereon as by bolts 48. Each of the blades 46 includes a cutting edge 50 disposed at the front thereof, that is, in the same direction as the rotational direction of the rotor as shown by the arrow in FIG. 2 and includes side portions 47 which when viewed from the downstroke side of the chamber upwardly angularly slant to a peak 52 disposed laterally centrally thereof. Each blade also has an angularly slanted front surface 54 which terminates in the cutting edge 50. In addition, the peak 52 of each blade is arcuately displaced along the circumferential cutting surface formed by the arcuate travel of the cutting edge 50 such that blade portions assume a compound angle, that is, they extend upwardly and rearwardly. Accordingly, the peak 52 is displaced to the rear or upstream in a direction of travel opposite to that of the rotor and behind a radial plane passing through the rotational axis of the rotor and the laterally displaced opposite ends of the blade portions 47.

The bed knives 32 and 34 are similarly shaped, that is, they assume a chevron configuration with side portions 58 thereof angularly directed to a peak 60 which in the case of the downstream bed knife 32 is arcuately displaced on the cutting circumference along the direction of travel of the rotor. Accordingly, the bed knife 32 includes a downwardly directed peak portion 60 whereas the upstroke bed knife 34 defines an upwardly directed peak 60. Thus, as the rotor blades and bed knives progressively contact each other initially at the lateral sides thereof, they form a generally trapezoidal opening 62 therebetween, the maximum height thereof being defined at the center. The height of the opening 62 is progressively narrowed so as to flatten its overall trapezoidal shape as the rotor blades 46 progressively move past the bed knives. In this regard it should also be pointed out that it is desirable that the contact between sets of blades 46 and 32 or 34 should be completed prior to initiation of cutting contact between another set thereof as the rotor rotates within the chamber 14 such that cutting impact and accordingly required peak power and noise levels are not unnecessarily increased. In this regard, the angular offset of the peak 52 of the rotor blades is limited to an extent such that the rotor blades will not "wrap around" each other, that is, the peaks will not extend between the lateral edges of the next adjacent upstream blade. In practice, it has been found that an angle of about 20° is the maximum in which the peak can be practically offset. Also, in this regard, it is desirable that adequate rotation movement force be retained by the rotor and for such purpose, it is desirable that the flanges 42 are not too drastically radially foreshortened such that weight/movement effect at the outer extent is overly reduced. In other words, the angular offset of the peaks 52 reduces the cutting circle defined by the rotor but such effect is balanced by the results achieved by the desirable rotor configuration of the present invention.

Figure 5:
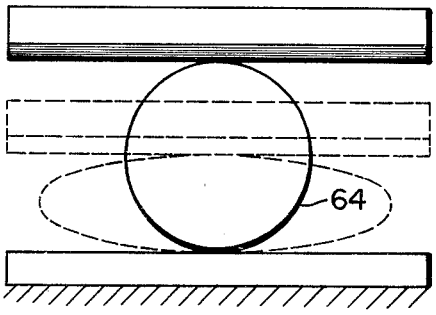
FIG. 5 PRIOR ART
FIGS. 5 through 7 are schematic representations of prior art blade configurations.
Figure 7:
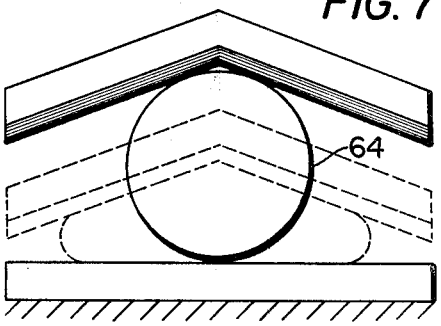
FIG. 7 PRIOR ART
Figure 6:
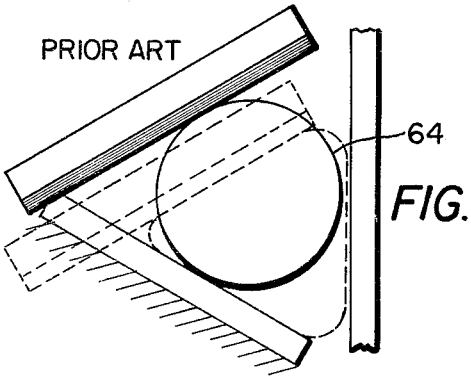
Figure 8:
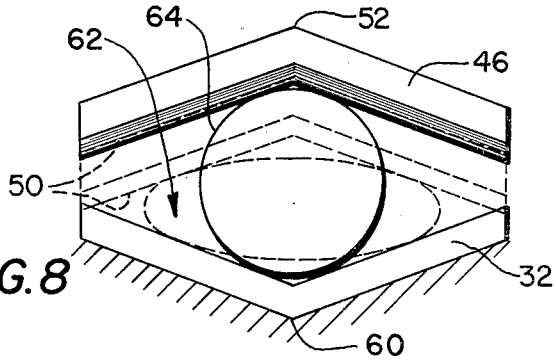
FIG. 8 is a schematic illustration of the blade knife of the present invention.

Turning now specifically to the schematic illustration of FIG. 8 of the drawings, the manner in which the rotor blade 46 and a bed knife, i.e. the downstroke bed knife 32, cooperate so as to engage an article 64 to be granulated therebetween as best illustrated. The article is assumed to be cylindrical and transversely disposed within the opening 62 for ease of illustration. Therein, it can be seen that the rotor blade 46 initially contacts the article 64 at upper spaced lateral positions and then progressively serves to simultaneously deform and cut the article as the rotor blade edges 50 move past the blade edges of the bed knife so that the opening 62 therebetween becomes progressively smaller or flatter, it being clear that the peak portions 52 and 60, respectively, are in general opposition to each other. Such action enables the article 64 to be in effect clamped in a secure position such that energy is not dissipated in forcing the article to one side or the other and enabling it to be progressively cut at four spaced points such that any required deformation of the article before cutting occurs is minimal, thus reducing power consumption and promoting break type cutting once shear type cutting is initiated. Furthermore, by reason of the secure clamping of the article within the opening 62, energy is not consumed in movement of the article from one side of the granulator to the other as shown in FIG. 6 or necessitated by the presentation of a large simultaneous area of cutting as in the prior art example illustrated in FIGS. 5 and 7 wherein the bed knife is of straight configuration.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A device for the size reduction of material comprising a frame, a chamber, a rotor mounted for rotation about an axis within said chamber, cutting means affixed to said rotor, bed knife means mounted on said frame at least on the downstroke side for projection into said chamber for cooperative cutting relationship with said cutting means as said rotor is driven, said cutting means including a rotor blade extending laterally across the face of said rotor with the forward cutting edge thereof defining the circumferential cutting plane of said rotor, said rotor blade of an overall generally chevron configuration having side portions thereof laterally angularly slanted towards each other to define a central peak thereof, said peak being further arcuately displaced from a radial plane passing through the laterally spaced sides of the blade in a rotational direction opposite to that of said rotor, said bed knife means including a similarly chevron shaped bed knife blade disposed with the peak thereof directed opposite to that of said rotor blade and with the cutting edge thereof radially outwardly offset from said rotor blade and further disposed with the peak thereof arcuately displaced from the sides thereof in the opposite direction of the displacement of said rotor blade such that the cutting edges of said blades may progressively pass across each other in evenly spaced relationship and form a progressively flatter generally trapezoidal opening therebetween upon such relative motion whereby articles to be cut thereby are contacted by said blades at laterally spaced locations on opposite surfaces thereof so as to clamp said articles within said opening.

2. The device of claim 1, wherein said rotor blade side portions meet at said central peak thereof.

3. The device of claim 2, both said rotor blades and said bed knife blade side portions angularly slanted at the same angle.

4. The device of claim 3, both said rotor blades and said bed knife peak portions arcuately offset at the same angle.

5. The device of claim 3, wherein the slant angle of said blade side portions is up to about 20°.

6. The device of claim 5, wherein the slant angle of said blade side portions is about 2°–10°.

7. The device of claims 4 or 5, wherein the peak of said blades is displaced at an angle of between about 2° to about 10°.

8. The device of claim 1, there being a plurality of rotor blades each disposed in arcuate spaced relationship from each other about said rotor.

9. The device of claim 1, wherein said rotor blade side portions terminate in central portions arcuately offset from each other.

10. The device of claim 1, there being additionally an upstroke bed knife blade positioned with respect to said chamber such that the peak thereof is directed toward the top of said chamber.

* * * * *